United States Patent [19]

Mayer

[11] 4,449,592

[45] May 22, 1984

[54] AUTOMATIC DRILL STRING SECTION CHANGER

[75] Inventor: James R. Mayer, Englewood, Colo.

[73] Assignee: Cooper Industries, Inc., Houston, Tex.

[21] Appl. No.: 246,310

[22] Filed: Mar. 23, 1981

[51] Int. Cl.[3] ..... E21B 19/14

[52] U.S. Cl. ..... 175/52; 175/57; 175/85; 173/164; 414/22

[58] Field of Search ..... 175/220, 85, 57, 52; 173/164; 414/22

[56] References Cited

U.S. PATENT DOCUMENTS

| | | | |
|---|---|---|---|
| Re. 30,071 | 8/1979 | Hilding et al. | 173/164 |
| 2,734,723 | 2/1956 | Larcen | 255/51 |
| 2,972,388 | 2/1961 | Thornburg | 414/22 |
| 2,976,943 | 3/1961 | Curtis | 175/223 |
| 3,025,918 | 3/1962 | Lever | 175/85 |
| 3,177,944 | 4/1965 | Knights | 166/77.5 |
| 3,286,777 | 11/1966 | Gyongyosi | 175/52 |
| 3,441,323 | 4/1969 | Vincent et al. | 308/3.9 |
| 3,493,061 | 2/1970 | Gyongyosi | 175/85 |
| 3,506,075 | 4/1970 | Attebo | 175/52 |
| 3,552,506 | 1/1971 | Mayer | 175/85 |
| 3,664,439 | 5/1972 | Council | 175/85 |
| 3,680,412 | 8/1972 | Mayer et al. | 81/57.34 |
| 3,684,039 | 8/1972 | Coyne | 175/85 |
| 3,913,753 | 10/1975 | Swartz et al. | 414/22 |
| 3,913,754 | 10/1975 | Swartz et al. | 414/22 |
| 3,965,994 | 6/1976 | Hilding | 175/52 |
| 3,966,053 | 6/1976 | Loftis | 175/85 |
| 3,976,149 | 8/1976 | Granholm et al. | 175/52 |
| 3,985,189 | 10/1976 | Jahnke et al. | 175/52 |
| 4,092,881 | 6/1978 | Jurgens et al. | 81/57.34 |
| 4,096,608 | 6/1978 | Lagerstedt | 175/220 |
| 4,676,337 | 2/1978 | Childress | 175/220 |

OTHER PUBLICATIONS

Publication of Gardner-Denver Company, "All Hydraulic Drilling Package".

*Primary Examiner*—William F. Pate, III
*Attorney, Agent, or Firm*—Harold E. Meier

[57] ABSTRACT

A mobile rock drill unit (10) is disclosed which automatically adds and removes drill string sections (26) from the drill string (24) of the drill unit. The drill unit includes a conventional drill motor (20) and a centralizer (40). A cylindrical storage rack (34) is both rotatably and pivotally mounted to the mast (14) of the drill unit and has upper and lower rack members (62,64) with aligned fingers (116,118,176,178) to define a number of drill string section storage positions to store drill string sections therebetween. A roller clamp assembly (36) is provided which clamps the coupling (28). The coupling is clamped between rotatably mounted driven and idler rollers (296,322) and the axis of rotation of each of the rollers is canted relative to the drill string axis so that rotation of the driven rollers in a first direction will rotate the coupling and move it downwardly at a rate synchronized with the threads interconnecting the coupling and adjacent drill string section. A control system (38) is provided which automates the task of adding and removing drill string sections from the drill string.

47 Claims, 16 Drawing Figures

AUTOMATIC DRILL STRING SECTION CHANGER

TECHNICAL FIELD

This invention relates to drilling equipment, and more particularly to drilling equipment that automatically changes a section in a drill string.

BACKGROUND ART

Attempts have been previously made to automate to various degrees the task of adding or removing sections to a drill string by means of a drilling apparatus such as a portable mobile drill unit. To complete the operation of adding sections it is typically necessary to have a storage rack to store a number of drill string sections, means to retrieve individual drill string sections from the storage rack, means to index the individual sections in line with the drill string axis, and means to couple a drill string section to the drill string. Removal of a drill string section from a drill string is accomplished by reversing the procedure utilizing the same apparatus.

It is still quite common for each drill string section to be manually placed for coupling in the drill string, thereby requiring the presence of someone on a continuous basis to add or remove the sections. Each section weighs approximately 60 pounds or more and may readily lead to operator fatigue.

In the typical application of a rock drilling unit, as an example, the drill string includes a number of drill string sections, typically each having a length of twelve feet. High pressure air is passed through the drill string sections to remove rock chips produced by the cutting face of the drill bit. Approximately 75% of the drill string sections employed in rock drilling have a hexagonal cross section, the typical drill string section having a one and one quarter inch hex. In the vast majority of applications, the rock drilling unit is employed to drill a hole of depth under forty feet. Therefore, the provision of storage rack holding four drill string sections, with one positioned on the drill string axis in the drill unit, will satisfy the vast majority of applications.

The typical service life of a drill string section varies in the range from 5000 to 20,000 feet of drilling. Unless provisions are taken to rotate the drill string sections, a drill string section adjacent the cutting head will reach the limit of its service life before drill string sections remote from the cutting head.

U.S. Pat. No. Re. 30,071 to Hilding et al discloses a drill string section handling apparatus. In that reference, the drill string sections are stored in an in-line manner in a magazine and transferred to the drill axis by means of a transfer arm. The drill section is held in the transfer arm by inclined rollers. The rollers are inclined at an angle which is comparable with the pitch angle of the thread on the drill string section and a number of the rollers are driven to rotate the drill section either into or out of the coupling sleeve on the section next ahead. In order to operate correctly, the drill string sections employed in the apparatus disclosed in this U.S. patent must have a round cross section to cooperate with the inclined rollers. As noted above, a majority of the drill string sections currently used have a hexagonal cross section. In addition, the in-line storage of the drill sections does not permit a change in the order of selection of the drill sections. Therefore, the first available drill section in the magazine is subject to more intensive use than those stored further back in the magazine.

A need has thus arisen for a drill string section changer that provides storage means, retrieving and indexing means with minimum operator input. In addition, a need has arisen for such an automatic changer adapted for use with a section having any crossectional configuration, and in particular in which hexagonal cross section drill string sections may be employed and in which the sections may be readily rotated in use to equalize the rate of wear.

SUMMARY OF THE INVENTION

In accordance with the present invention, an automatic drill string section changer for use in a drill unit is provided.

In accordance with the present invention, there is provided a storage rack for storing a drill string section for use in a drill string. The storage rack comprises an upper rack member having at least one arm extending therefrom, the arm having clamping means thereon. Further, the rack includes a lower rack member having at least one arm extending therefrom, the lower arm also having clamping means thereon. In addition, the storage rack includes means for interconnecting and aligning the clamping means of the upper and lower rack members so that a drill string section may be clamped between the clamping means of the upper and lower rack members to store the drill string section.

According to the present invention, there is provided an apparatus for storing and individually indexing a plurality of drill string sections on a drill string axis for use in a drill unit. The apparatus comprises a storage rack having a plurality of storage positions about the outer periphery thereof, the storage rack being mounted for rotation about a center axis and for pivotal motion relative to the drill string axis of the drill unit so that the stored drill string sections are aligned parallel to the drill string axis. The apparatus further comprises means for pivoting the storage rack between a retracted position and an indexing position to index each storage position so that a drill string section stored therein is aligned on the drill string axis. The means for indexing rotates the storage rack to position each storage position so that a drill string section stored therein is indexed on the drill string axis as the pivot means again pivots the storage rack into the indexing position.

The present invention also provides an apparatus for use in a drill unit for clamping a section in a drill string. The apparatus comprises guide means secured to the drill unit, first jaw means mounted for motion along said guide means and defining a first surface for contacting the section and second jaw means mounted for motion along the guide means defining a second surface for contacting the section. The apparatus further includes means for moving the first and second jaw means along the guide means to clamp the section therebetween. The first and second jaw means are centered with respect to the section as the jaw means clamps the member.

Also forming a part of the present invention is a method for adding drill string sections to a drill string to rotate a bit by rotating means as a part of a drill unit for drilling a borehole along a drill string axis. The means for rotating the drill string includes means for moving the drill string along the drill string axis, the drill string being comprised of sections threadedly interconnected to each other and to the rotating means. The method comprises the steps of clamping a first section, said first section being uppermost in the drill string and threadedly interconnected to the rotating means; unscrewing the rotating means from the first section; and moving the rotating means upward in response to the clamping of the first section. The method further includes the steps of indexing a second section on the drill string axis above said first section in response to the upward movement of the rotating means; threading the rotating means into the second section; and urging the second section downward toward the first member in response to the indexing of the second section on the drill string axis.

The method of the present invention also provides for removing sections from a drill string having a drill bit at its lower end and being operated by a drill unit to drill a borehole along a drill string axis. The drill unit includes means for rotating the drill string and for lifting the drill string along the drill string axis, each of the sections being threadedly interconnected to each other and to rotating means. The method comprises the steps of indexing a storage rack on the drill string axis to clamp a first section thereto, the first section being the uppermost member in the drill string and connected to the rotating means; unscrewing the rotating means from the first section; and moving the rotating means upward in response to the indexing of the storage rack. The method further comprises the steps of clamping a second section in a roller clamp assembly, the second section being threadedly secured to the lower end of the first section, in response to the upward motion of the rotating means. The method further includes the steps of unscrewing the second section from the first section by rotating the second section in the roller clamp assembly in response to the clamping of the second section; and retracting the storage rack to move the first section off the drill string axis.

BRIEF DESCRIPTION OF THE DRAWINGS

A more complete understanding of the invention and its advantages will be apparent from the following Detailed Description taken in conjunction with the accompanying Drawings in which.

FIG. **14*a* and 14*b* are partial vertical cross-sectional views taken along lines 14*a*—14*a* and 14*b*—14*b*, respectively, in FIG. 10 and illustrate the roller clamp assembly of the present invention.

DETAILED DESCRIPTION

Figure 1:
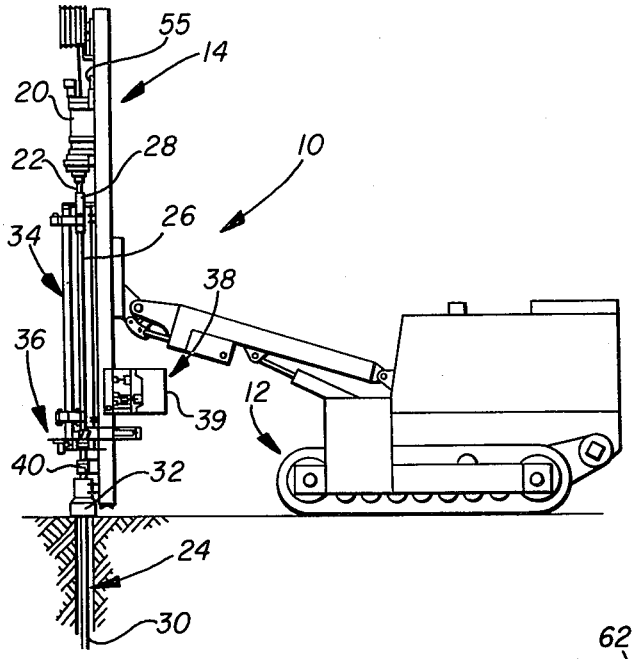
FIG. 1 is a vertical plan view of a mobile rock drill unit employing the present invention.
Figure 3:
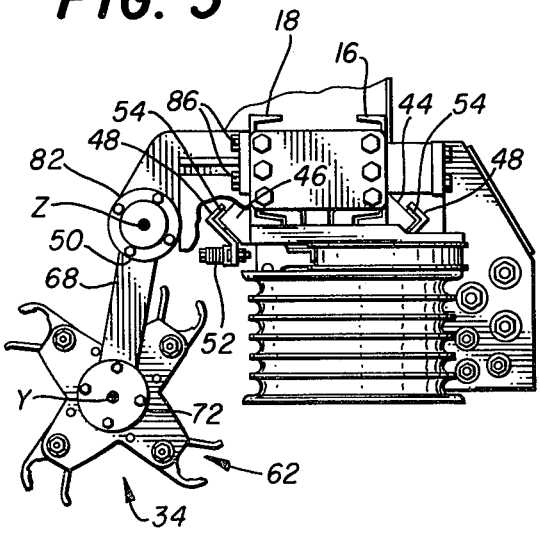
FIG. 3 is a top plan view of the mast of the mobile rock drill unit.
Figure 13:
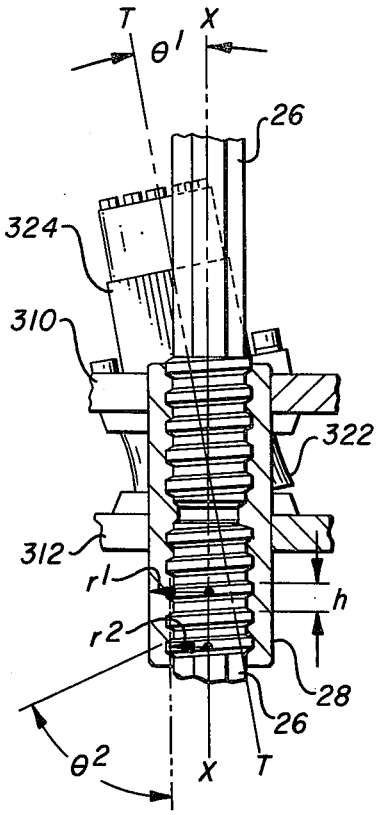
FIG. 13 is a vertical cross-sectional view taken along line 13—13 in FIG. 8.

Referring now to the Drawings wherein like reference numerals designate like or corresponding parts throughout the several views, and particularly referring to FIG. 1 thereof, there is shown a mobile rock drill unit 10 illustrated in a vertical drilling position. The drill unit 10 is a part of a crawler-type undercarriage 12 adapted to adjustably mount an elongated mast 14. The mast 14 is constructed of two inwardly turned channel members 16 and 18, as best shown in FIG. 3, which provide for slidably mounting a pressure fluid operated drill motor 20. The drill motor 20 is of a well known percussion type and includes a short section of drill steel in the form of a threaded shank portion 22 extending from the lower end thereof. The shank portion 22 is adapted to transmit percussion blows and rotational motion provided by the drill motor 20 to a drill string 24 in a manner well understood by those of ordinary skill in the art. The drill string 24 is formed of individual drill string sections 26 having both ends threaded which are interconnected by couplings 28 having opposed internal threads to receive the ends of drill string sections 26 as best shown in FIG. 13.

Again having reference to FIG. 1, the major components of the drill unit 10 are mounted on the mast 14. These components include a cylindrical storage rack 34, a roller clamp assembly 36, a control system 38, centered in a control station 39, and a pivoted guide type drill section centralizer 40. The centralizer 40 is of the type described in U.S. Pat. No. 3,441,323. The jaw portions close to guide the drill string and prevent vertical passage of a coupling therethrough while permitting passage of a drill string section. When open, the centralizer does not impede vertical motion of either the drill string section or coupling.

The mobile rock drill unit 10 is provided with a source of pressurized hydraulic fluid from any conventional power source. The drill motor 20, typically a fluid actuated hammer, not shown, impacts the shank portion 22. The hammer impacts are transmitted through the shank portion 22 and the drill string 24 to a bit (not shown) which breaks up the underlying earth formation to form the borehole 30 in a well understood manner. Typically, the bit employed is either of the X bit or button bit type. To enhance the cutting action of the bit, it is rotated during the drilling operation by the drill motor 20. Preferably, the rotation may be reversed and operated independently of the hammering action.

Compressed air is forced through the hollow center core of the drill string sections and couplings to the cutting face at the bottom of the borehole. The compressed air entrains rock chips formed at the working face and carries them away from the face in an annular flow around the drill string and out the top of the borehole. The rock chips exiting from the borehole are collected in a dust control hood 32 as shown in FIG. 1. The dust control hood 32 connects to a source of vacuum, not shown, and a collection hopper for collecting the chips.

Figure 10:
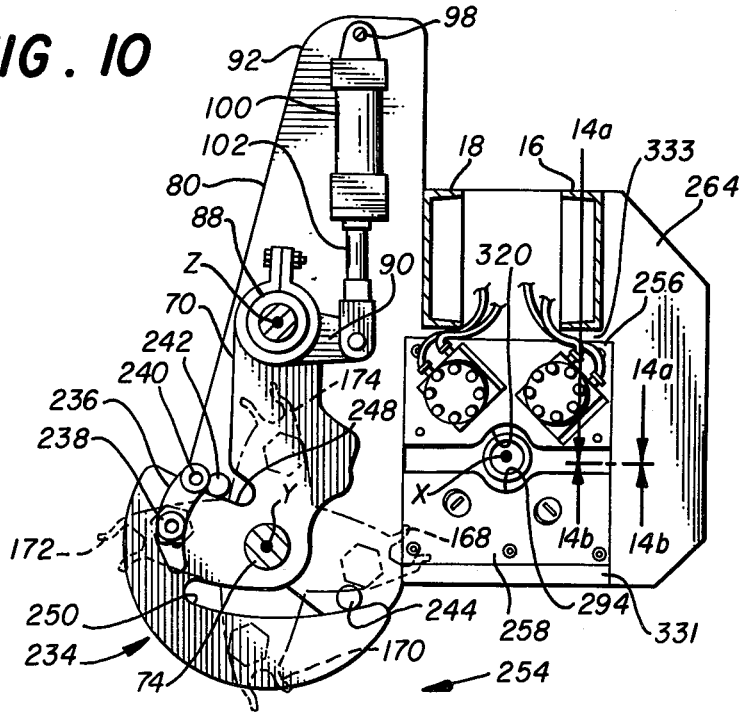
FIG. 10 is a top cross-sectional view of the cylindrical storage rack of the present invention illustrating the storage rack in an intermediate position.

Rock drill units such as illustrated in FIG. 10 are used to drill boreholes to a depth between 200 and 300 feet. At about that depth the annular flow of the compressed air carrying the rock chips from the cutting face falls below a flow of from 2,000 to 3,000 feet per minute. In the vast majority of cases, however, the borehole 30 is drilled to a depth of less than 40 feet.

The pitch "h" and the flank angle $\theta^2$ of the threads in the drill string as illustrated in FIG. 13 are selected so that the threads will be tightly interlocked when drilling but may be loosened by rattling the drill string by conventional means. Traditionally, the threads of the drill string sections in percussive rock drilling are left handed.

Figure 2:
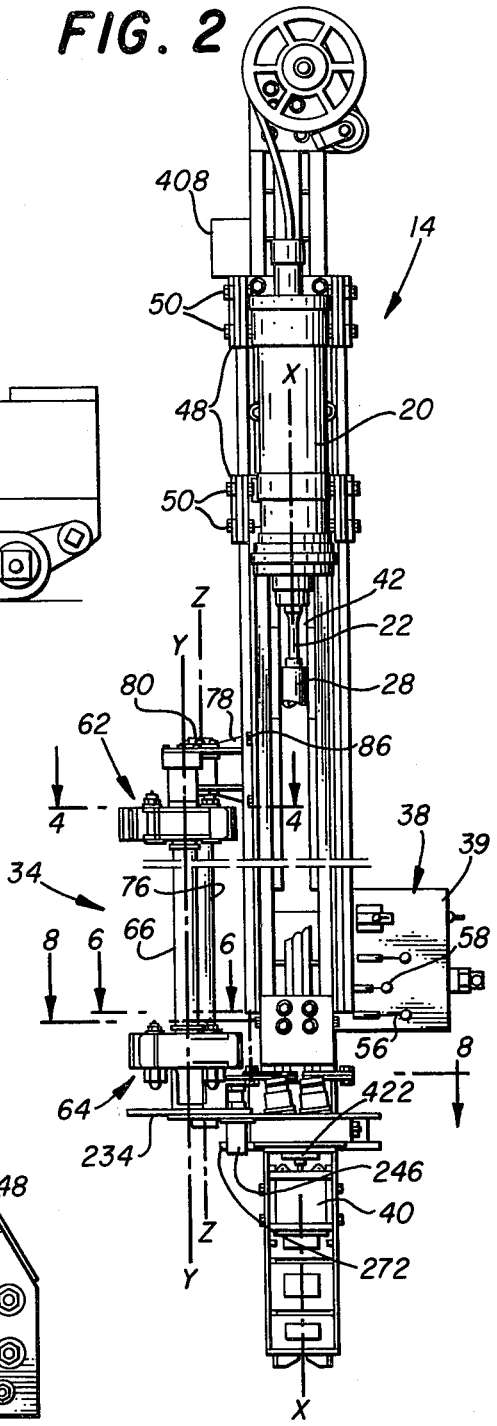
FIG. 2 is a foreshortened vertical plan view of the mast of the mobile rock drill unit.

With reference to FIG. 2, the drill motor 20 is slidably positioned along the mast 14 by means of a drill feed cylinder 42 mounted to the mast top. The drill feed cylinder 42 is connected to the drill motor by means of a chain and chain sprocket which are not shown. The chain and sprocket permit the drill feed cylinder 42 to have a piston rod travel equal to one half the distance of drill motor 20 so that the length of the hydraulic cylinder is shortened.

As best illustrated in FIG. 3, the drill motor is guided along the mast by guides 44 and 46 mounted on channel sections 16 and 18, respectively. In the preferred embodiment these guides are constructed of aluminum. The drill motor 20 includes opposed sets of guide fingers 48 which are mounted by means of bolts 50 and urged toward the guides 44 and 46 by springs 52, such as Belleville springs. Inserts or pads 54 are provided between the guide fingers 48 and the guides 44 and 46 to increase the positioning accuracy of drill motor 20 along the mast 14. The inserts 54 are preferably formed from plastics. This arrangement maintains the shank portion 22 substantially centered on the drill axis X—X throughout the entire range of motion of drill motor 20 from the top of the mast abutting stop 55 to the bottom. In addition, this arrangement has the further advantage of acting as a holding device so that if the chain between the drill motor 20 and drill feed cylinder 42 breaks, the drill motor 20 will be restrained in its downward motion.

Figure 15:
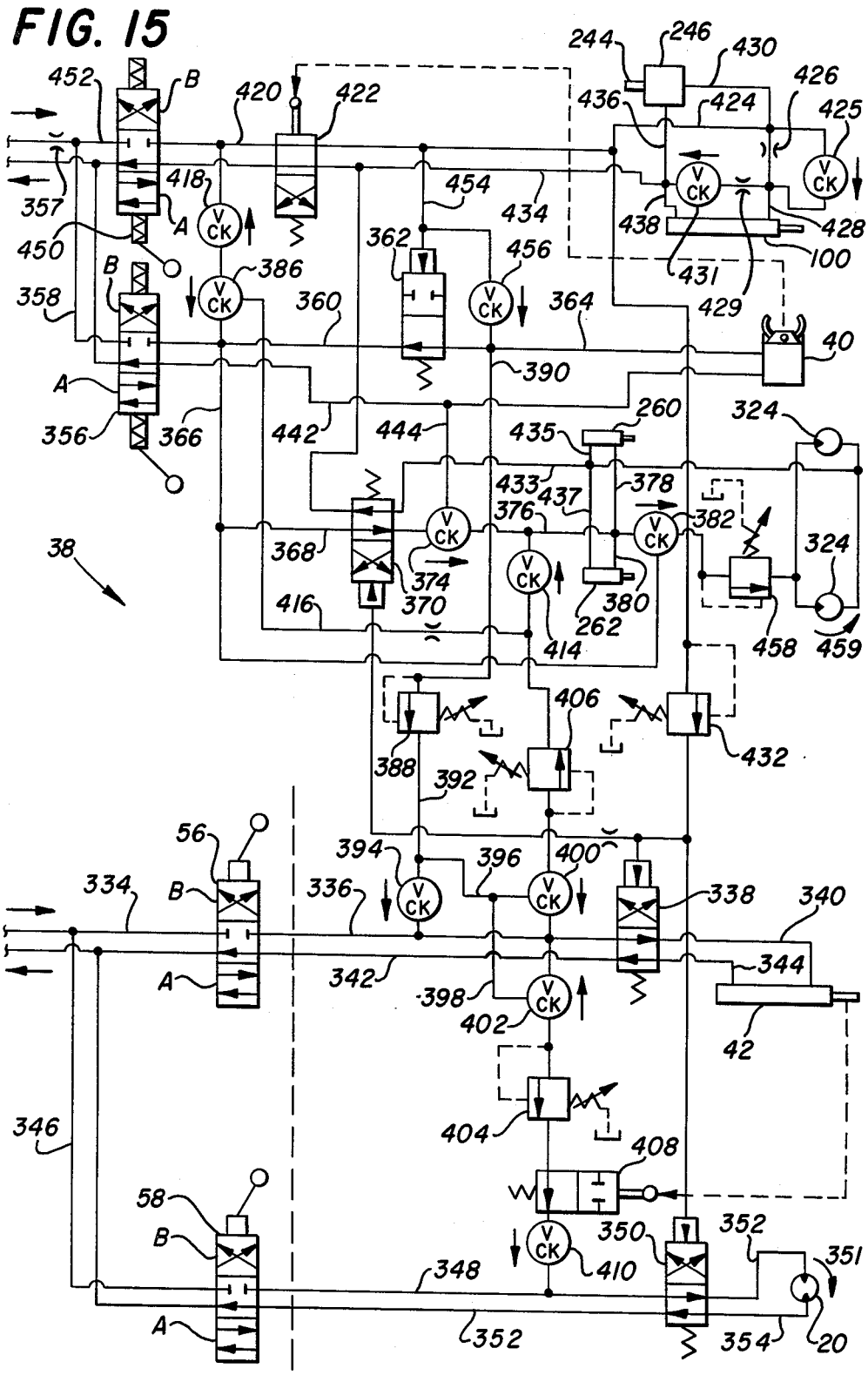
FIG. 15** illustrates the hydraulic circuit for operating the apparatus of the present invention.

The drill feed cylinder 42 is operated by a three position manually controlled drill feed valve 56 operated from control station 39. The drill feed valve is spring loaded to a neutral position thereby preventing flow of hydraulic fluid to either side of the piston of the drill feed cylinder 42. Motion of the drill feed valve 56 to a first position "A", as illustrated in FIG. 15, actuates the drill feed cylinder 42 so that the drill motor 20 is moved upwardly along mast 14. The drill feed valve 56 is operable in a second position "B" to introduce hydraulic fluid into the drill feed cylinder 42 to lower the drill motor 20 downward on mast 14 and toward the borehole.

Similarly, a manually operated drill rotation valve 58 is provided on control station 39 to control the drill motor 20. In a spring loaded neutral position, flow of hydraulic fluid is blocked to the drill motor 20 and the threaded shank portion 22 is not rotated. Actuating the drill rotation valve in a first position "A" introduces hydraulic fluid into the drill motor 20 so that the shank portion 22 is rotated in a first direction to uncouple or loosen the threads of the drill string. Operation of the drill rotation valve 58 in a second position "B" induces opposite rotation of the threaded shank portion 22 in a second direction to make-up and tighten the threads of the drill string.

The hydraulic hoses necessary to provide pressurized hydraulic fluid from a pressure source within the mobile rock drill unit 10 to the drill motor 20 and drill feed cylinder 42 conventional and known in the art. A hose reel 60 is provided to minimize damage to these hoses.

With reference now to FIGS. 2–10, the cylindrical storage rack 34 will be described in detail. The cylindrical storage rack 34 includes an upper rack member 62, a lower rack member 64 and a vertical center shaft 66 on which the members 62 and 64 are mounted for common rotation about an axis Y—Y. The vertical center shaft 66 is rotatably mounted at its ends on upper swing arm 68 and lower swing arm 70 as shown in FIG. 10 by structures 72 and 74, each including a cylindrical bearing, respectively.

The upper swing arm 68 is mounted at its opposite end to the top of a pivot shaft 76. The lower swing arm 70 is secured to the lower portion of pivot shaft 76. Pivot shaft 76 in turn is pivotally mounted at its upper end to upper support arm 78 and at its lower end to lower support arm 80 by structures 82 and 84, also containing cylindrical bearings, respectively. The upper support arm 78 is secured by fasteners 86 to the channel section 18 as best shown in FIGS. 2 and 3.

Figure 8:
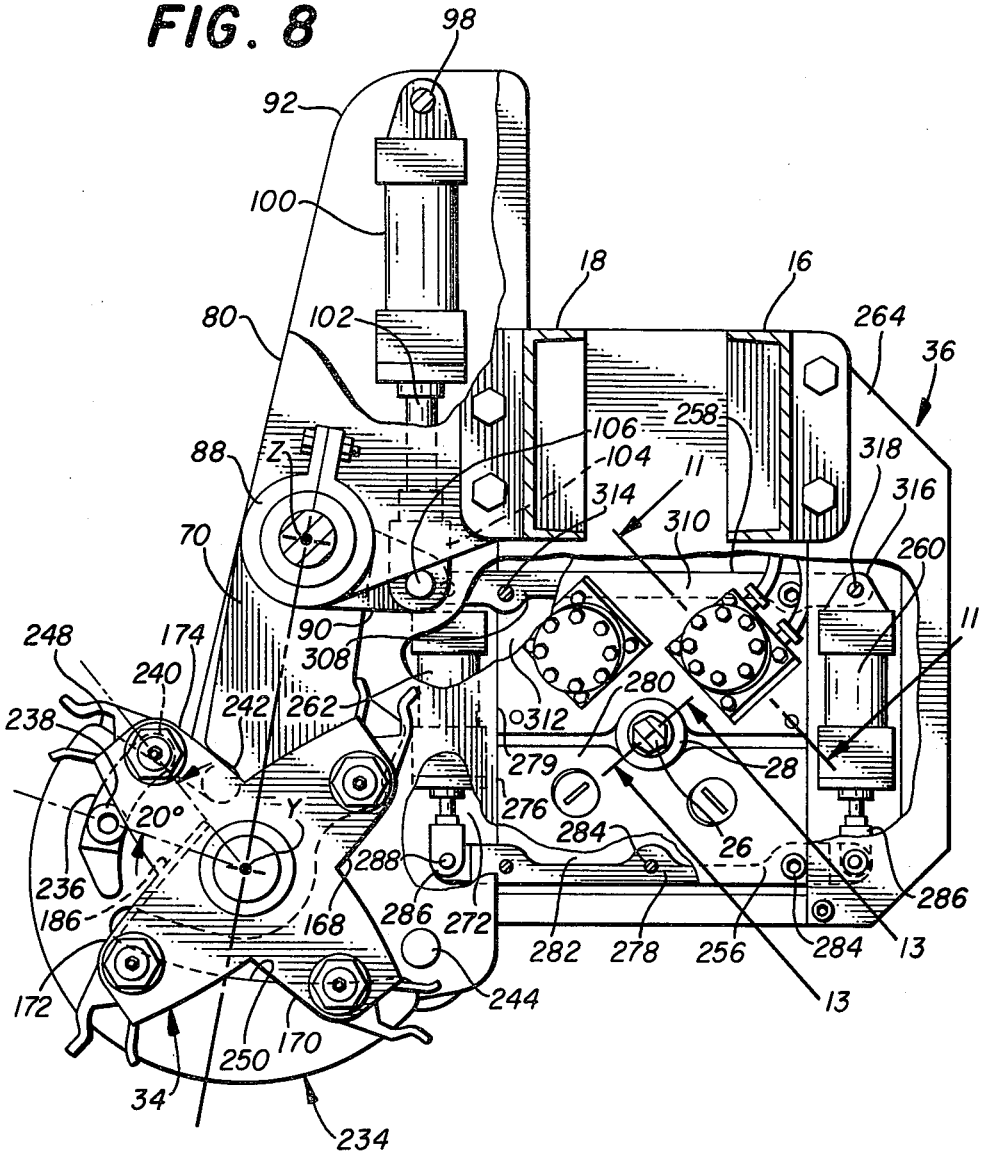
FIG. 8 is a top cross-sectional view of the cylindrical storage rack of the present invention taken along line 8—8 in FIG. 2 and illustrating the storage rack in the retracted position.
Figure 9:
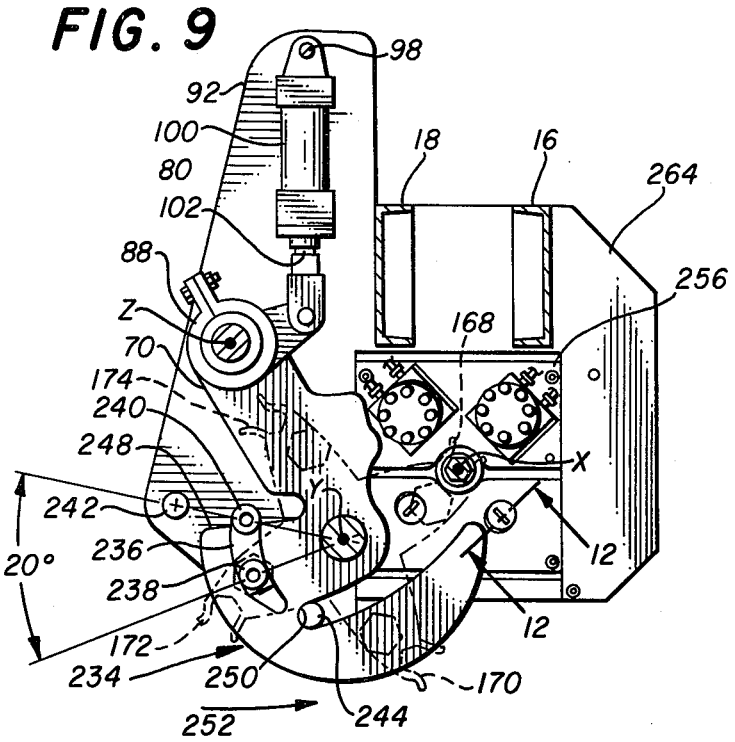
FIG. 9 is a top cross section of the cylindrical storage rack of the present invention illustrating the storage rack in the indexing position.

A hub 88, as best shown in FIGS. 8–10 is secured to the lower swing arm 70 and is provided with a pivot arm 90. An indexing plate 92 is spaced below the lower support arm 80 and also secured to the channel member 18. Aligned holes are formed in lower support arm 80 and indexing plate 92 for receiving a pin 98 to engage one end of a storage rack swing cylinder 100. The piston 102 of swing cylinder 100 has a clevis 104 at the piston rod end which is pivotally mounted to the pivot arm 90 by pin 106. The swing cylinder 100 is double acting so that the cylindrical storage rack 34 may be pivoted about an axis Z—Z from a retracted position as shown in FIG. 8, through an intermediate position as shown in FIG. 10 to an indexing position as shown in FIG. 9 and return to the retracted position.

Figure 4:
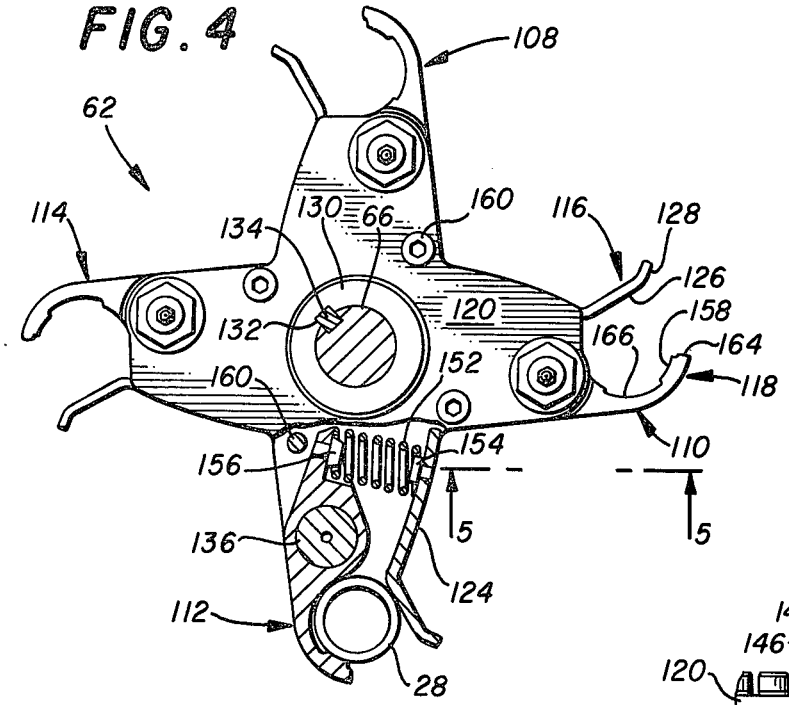
FIG. 4 is a top plan view, partially in cross section, of the upper rack member of the present invention taken along line 4—4 in FIG. 2.
Figure 5:
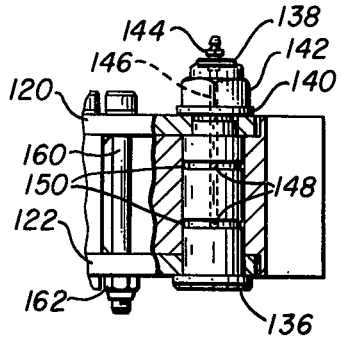
FIG. 5 is a vertical cross-sectional view taken along line 5—5 of FIG. 4.

With reference to FIGS. 4 and 5, the upper rack member 62 will be described in detail. The upper rack member 62 has four arms 108, 110, 112 and 114, each at approximately 90° angles to the next adjacent arm. Each arm has a fixed finger 116 and a clamping finger 118 at its outermost extension. The fixed and clamping fingers 116 and 118 are designed to clamp a coupling 28 therebetween.

The upper rack member 62 is constructed of a top plate 120 and a bottom plate 122 interconnected by side plates 124 which extend to form the fixed finger 116. The fixed fingers 116 have a generally planar inner contact surface 126. When loading arm 110, clamping finger 118 contacts the coupling in a manner to open the clamping finger and admit the coupling between the fixed and clamping fingers.

Figure 6:
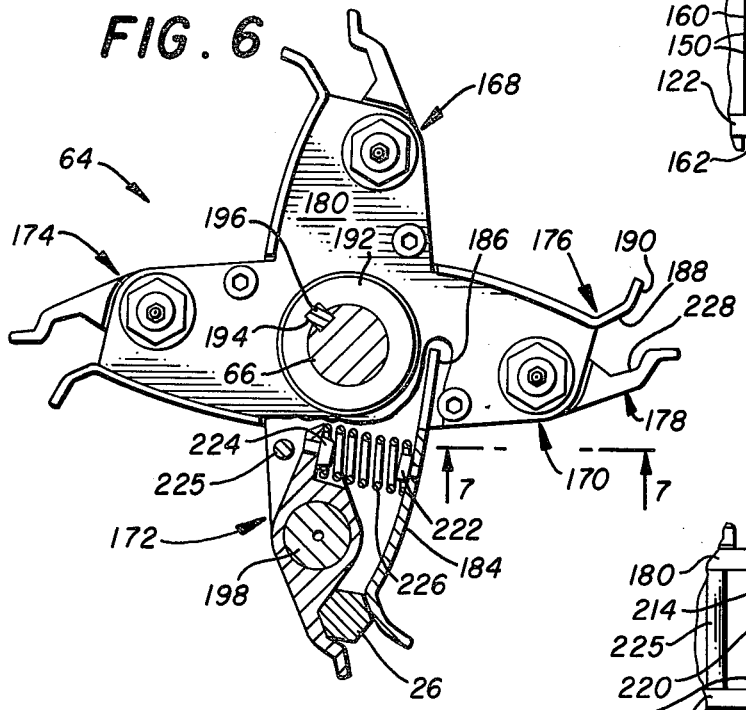
FIG. 6 is a top plan view, partially in cross section, of the lower rack member taken along line 6—6 of FIG. 2.
Figure 7:
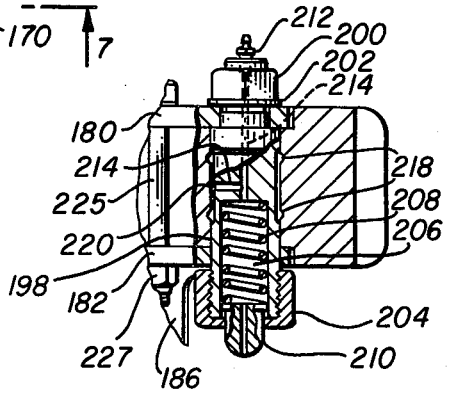
FIG. 7 is a vertical cross-sectional view along line 7—7 of FIG. 6.

With reference now to FIGS. 6 and 7, the structure of lower rack member 64 will be described. The structure of the lower rack member 64 is similar to that of the upper rack member 62 with several exceptions. The lower rack member 64 forms arms 168, 170, 172 and 174, extending at approximately 90° angles from the next adjacent arm, each includes a fixed finger 176 and a clamping finger 178. The lower rack member is constructed of a top plate 180, a bottom plate 182 and side plates 184. The side plates extend below the bottom plate 182 to form a camming surface 186. The side plates 184 also extend to form the fixed fingers 176 with a generally planar inner contact surface 188 and guide surface 190. A hub 192 forms a part of the rack member 64, and is provided with a slot 194 for receiving a key 196 on the vertical center shaft 66.

Each clamping finger 178 is pivotally mounted to an arm by means of the pivot pin 198. One end of pivot pin 198 is threaded to receive a nut 200 and washer 202. The opposite end of each pin 198 is threaded to receive a nut 204 and is formed with a hollow portion 206. A helical compression spring 208 is received in the hollow portion 206 and urges a detent 210 against the flange of nut 204. A lubrication grease fitting 212 opens into passages 214 that terminate in grooves 218, formed in the clamping finger 178, and groove 220, formed in the pivot pin 198.

Each arm in the lower rack member 64 is provided with two pairs of spring mounts 222 and 224 (only one shown) to secure two helical compression springs 226 (only one shown) in each arm to bias the clamping finger 178 towards the fixed finger 176. A bolt 225 is assembled to the rack member at the position shown on each arm by a nut 227 to form a fixed stop.

In one phase of the operation of drill unit 10, storage rack 34 pivots about axis Z—Z from the indexing position shown in FIG. 9 to the retracted position shown in FIG. 8 in the direction of the arrow 254 shown in FIG. 10. During this pivotal motion, the pin 244 is retracted so that it will not interfere with a camming surface on the lower rack member 64. The pivotal motion of the cylindrical storage rack 34 about axis Z—Z toward the retracted position does not induce rotational motion of the rack member 62 and 64 about axis Y—Y until the intermediate position shown in FIG. 10 is reached. At the intermediate position, the fixed pin 242 contacts the camming surface of arm 174. Further pivotal motion of the cylindrical storage rack 34 about axis Z—Z causes rotation of the rack members 62 and 64 a total of 20° before the storage rack returns to the retracted position. In this rotation about axis Y—Y, the detent 210 of arm 172 moves from notch 238 to notch 240, thereby preventing over rotation of the rack members 62 and 64.

It is clear from the above description that further activation of swing cylinder 100 and pivotal motion of the cylindrical storage rack 34 about the axis Z—Z will automatically index each storage position of the storage rack on the drill string axis X—X in sequence. While the pivotal motion of the storage rack 34 about axis Z—Z is in two directions, that of arrows 252 and 254, the rotational motion of the rack members 62 and 64 about axis Y—Y is in a single direction, clockwise as viewed in FIGS. 8–10.

In the preferred embodiment, the cylindrical storage rack 34 may store four drill string sections 26 and couplings 28 removed from the drill string 24. By operation of the apparatus described, four drill string sections 26 and couplings 28 stored in the rack 34 may be indexed sequentially on the drill string axis X—X for lengthening the drill string 24. The cylindrical storage rack 34 may also be rotated by consecutive actuations of swing cylinder 100. The sequence of the positioning of the drill string sections may be changed to equalize the wear on the drill string sections.

With reference to FIGS. 8 and 11–14, a detailed description of the roller clamp assembly 36 and its function is provided. Generally, a front jaw 256 and a rear jaw 258 are slidably mounted on the mast 14. The jaws are interconnected by double acting roller clamp actuators 260 and 262 which when activated urge jaws 256 and 258 together to clamp a coupling 28 therebetween. The slidable mounting of the jaws 256 and 258 permits the roller clamp assembly 36 to be self centering in one dimension.

Figure 14A:
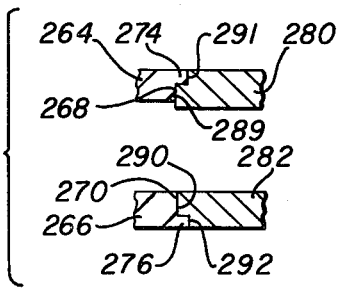
Figure 14B:
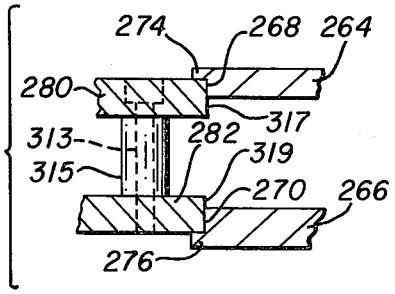

To slidably mount the jaws 256 and 258, an upper guide plate 264 and lower guide plate 266 (FIG. 8) are mounted to channel member 16 to define lateral guide surfaces 268 and 270 as illustrated in FIGS. 14*a* and 14*b*. Similarly, a lower guide plate 272 (FIG. 8) secured to channel member 18 and indexing plate 92 (FIGS. 9 and 10) define lateral guide surfaces with parallel surfaces 268 and 270. Upper guide plate 264 and lower guide plate 266 define lips 274 and 276, respectively. Similar lips are defined on lower guide plate 272 and indexing plate 92.

Two stop members 331 and 333 are mounted between the guide plates and indexing plate to limit the outward motion of the front and rear jaws 256 and 258. FIG. 10 illustrates the front and rear jaws abutting against the stop members 331 and 333, respectively, with the jaws in the open position. In the open position, free passage of the couplings in the drill string is permitted.

The front jaw 256 includes a yoke 278 and upper and lower jaw plates 280 and 282. The upper and lower jaw plates are fastened on the upper and lower surface, respectively, of yoke 278 by bolts 284. The yoke 278 extends between the guide plates on either side to be coupled to clevices 286 of the actuators 260 and 262 and secured thereto by pins 288. Surfaces 289 and 290 of the guide plates are positioned by guide surfaces 268 and 270 as illustrated in FIG. 14*a*. The upper and lower jaw plates 280 and 282 each have notches 291 and 292 formed at their outer edges to cooperate with lips 274 and 276 to slidably support the front jaw 256. The jaw plates 280 and 282 include an arcuate cutout 294 on their inner side which has a radius larger than the radius of the outer surface of a coupling 28.

The rear jaw 258 is similarly constructed from a yoke 308 and upper and lower jaw plates 310 and 312 secured thereto by bolts 314. The ends of the yoke 308 also extend between the guide plates and are coupled to clevices 316 of roller clamp actuators 260 and 262 and secured thereto by pins 318. Cap screws 313 and spacers 315 are provided as shown in FIG. 14*b* to space the jaw plates. The edge surfaces 317 and 319 of the jaw plates are also guided along guide surfaces 268 and 270. As can be seen in FIG. 14*b*, the lips 274 and 276 extend over the edge surface of the jaw plates to guide the rear jaw 258.

The inner surface of the jaw plates 310 and 312 also has an arcuate cutout 320 of radius greater than the outer radius of the couplings 28.

Figure 11:
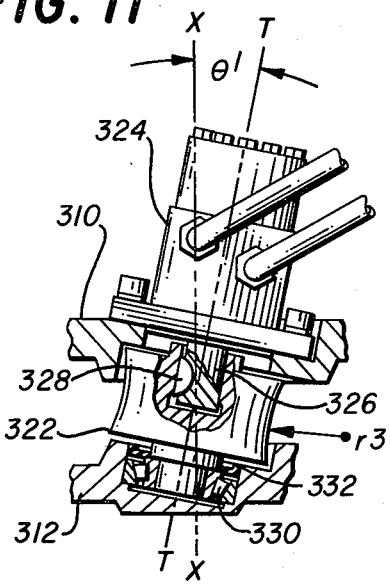
FIG. 11 is a vertical cross-sectional view taken along line 11—11 in FIG. 8 and illustrates the driven roller utilized in the roller clamp assembly of the present invention.

Driven rollers 322 are rotatably mounted between the jaw plates 310 and 312 as shown in FIGS. 11 and 13. In the preferred embodiment, reversible hydraulic motors 324 are provided to rotate the driven rollers 322 through a motor shaft 326 keyed to the rollers by a key 328. A roller bearing 330 and seal 332 are provided in lower jaw plate 312 to support the driven rollers. The axis of rotation T—T of the driven rollers is similarly canted at an angle $\theta^1$ from the drill string axis X—X in order to synchronize the downward motion of the coupling with the pitch of the thread in unscrewing a coupling. The driven rollers 322 have a concave surface of radius $r^3$ to define a line of contact with a coupling 28 which is similar to that of the idler rollers 296.

Figure 12:
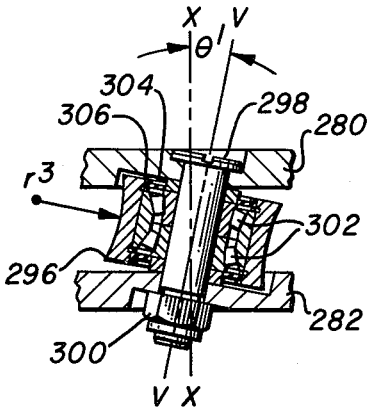
FIG. 12 is a vertical cross-sectional view taken along line 12—12 in FIG. 9 and illustrates the idler roller for use in the roller clamp assembly.

Idler rollers 296 are rotatably mounted between the jaw plates 280 and 282 by means of pins 298 as shown in FIG. 12. Each pin 298 is maintained in its position by a nut 300. A set of roller bearings 302 are provided with retaining rings 304 and seals 306 to rotatably mount the idler rollers 296 on the pin 298. A portion of idler rollers 296 extends inward of the cutout 294 to contact the outer surface of a coupling 28 when the coupling is clamped between the jaws 256 and 258 as shown in FIGS. 8 and 9.

As can be seen in FIGS. 12 and 13, the rotational axis V—V of the idler roller 296 is canted or angled from the axis X—X by an angle $\theta^1$. The radius of the outer surface of the coupling is $r^1$. The thread at the ends of the drill string sections 26 and the internal thread of couplings 28 have a pitch, h.

In order to disconnect the coupling while moving it in a downward direction away from the drill string section at a rate which is synchronized with the pitch of the drill string thread, the angle $\theta^1$is related to the noted parameters by the following equation:

$$\theta^1 = \text{ARC tan } (h/2r^1 \times \pi)$$

The canting of the rollers permits the coupling to move axially in one revolution exactly the distance the threads will cause the coupling to move. For example, if "h"=0.50 inches and $r^1$=1.125 inches $\theta^1$=4.046°. $\theta^2$ is the flank angle of the threads which represent the angle of the contact surfaces of the threads with respect to the axis of the drill string. Radius $r^2$ represents the radius of the thread from the center of the drill string to the pitch line of the threads.

In order to properly contact the coupling 28 along a contact line, the rollers 296 must be formed with a slightly concave surface having a curvature of radius $r^3$. The concave surface has been exaggerated in FIG. 14 for illustrative purposes. For a roller having an average diameter of 4" and a width of 2¼", the variation in diameter from the ends of a roller to the center is approximately 0.00226" and $r^3$ is approximately 281". In the preferred embodiment, the rollers 296 are formed of case hardened carborized steel to minimize wear. If more resilient rollers are employed instead of steel rollers, the concave surface may be formed into the material by the clamping force itself.

A number of rollers 296 and 322 are rotatably mounted to the jaws for actual contact with a coupling 28 to be clamped therebetween. At least one of these rollers is rotated by a motor 324. The axis of rotation of each of the rollers 296 and 322 in contact with the coupling is canted relative to the drill string axis X—X at an angle compatible with the angle of pitch of the threads of the coupling. This enables the rollers to be rotated in a direction which unscrews the coupling 28 clamped between the jaws from the uppermost drill string section 26 in the drill string 24 while moving the coupling downwardly away from the uppermost drill string section at a rate which is synchronized with the pitch of the thread. In this manner, the uppermost drill string section may remain stationery and clamped in storage rack 34 while unscrewing the clamped coupling and drill string below.

It can be readily understood from the description above that the roller clamp assembly 36 serves two functions. The first function is to clamp a coupling 28 between the idler rollers 296 and driven rollers 322. As noted above, the slidable mounting of the jaws 256 and 258 permit the roller clamp assembly to be self centering along one lateral axis parallel the guide surfaces. This insures that the clamping force between each of the rollers and the coupling is equivalent and prevents any deflection of the drill string 24 as a result of the clamping force. The second function of the roller clamp assembly 36 is to unscrew a coupling 28 clamped therebetween from the threaded end of a drill string section 26 while moving it away from the drill string section at a rate synchronized with the pitch of the thread so that the drill string section may remain fixed relative to the drill unit 10.

The present invention also provides a control system 38 for automatically adding or removing drill string sections from a drill string. A description of this control system is given with reference to FIG. 15. The automatic system of the present invention is operated by pressurized hydraulic fluid. However, any suitable equivalent may be substituted, such as an electrical power source, in which case hydraulic circuitry may be substituted for by microswitches or proximity switches or similar equivalent mechanisms.

For purposes of describing the operation of the control system 38, a hydraulic source at a pressure of 3,000 p.s.i. is provided and the values of the various components in the control system will depend on this source pressure. It should be understood, however, that the principles of the control system are equally applicable to different source pressures.

Activation of the drill feed valve 56 to position A permits high pressure hydraulic fluid to flow through line 334, line 336, through a pilot valve 338 (in the position shown) to line 340 and into the drill feed cylinder 42 to raise the drill motor 20 upward along mast 14. Actuation of drill feed valve 56 into position B reverses the flow so that high pressure hydraulic fluid flows through line 334, line 342, the pilot valve 338 (unactuated) and to line 344 connected to the drill feed cylinder 42 to move the drill motor 20 downward along the mast 14.

Activation of drill rotation valve 58 to position A permits high pressure hydraulic fluid to flow through line 346, line 348 and a pilot valve 350 (in the position shown) to line 352 connected to the drill motor 20 to rotate the threaded shank portion 22 in the direction of arrow 351. This direction of rotation results in a disengagement of the threaded shank portion 22 from the top coupling in the drill string 24. If the drill rotation valve 58 is actuated to a position B, high pressure hydraulic fluid flows through line 346, line 352 and through the pilot valve 350 (in the position shown) to line 354 and into the drill motor 20 to rotate the threaded shank portion 22 in a direction opposite arrow 351. This direction of rotation results in an engagement of the top coupling in the drill string 24. The drill feed valve 56 and drill rotation valve 58 may be operated in the conventional manner as well known in the art for drilling the borehole 30 and drawing the drill string out of the borehole.

When drilling the borehole 30, the drill motor 20 is moved downward along the mast by operation of the drill feed valve 56 applying pressure to the feed cylinder 42 until the top coupling in the drill string is slightly below the top of centralizer 40. At this point it is necessary to add a new drill string section to the drill string. The drill string is then "rattled" by conventional means to loosen the couplings, although it is necessary to loosen only the top coupling. The drill string is then raised by activating drill feed valve 56 into position A until the top of the top coupling, attached to the threaded shank portion 22 of drill motor 20, is flush or slightly above the roller clamp assembly 36. Drill feed valve 56 is then released to shut off flow to the drill feed cylinder 42.

The control system 38 of the present invention controls an automatic operational sequence which positions a drill string section stored in the cylindrical storage rack 34 onto the drill string axis and screws the threaded shank portion of the drill motor 20 into the top coupling of the drill string in response to the actuation of a manually operated valve 356. Valve 356 is normally in a neutral position blocking flow of hydraulic fluid from line 358 to line 360. To initiate the sequence of adding a new drill string section, the valve 356 is operated to position A which permits flow of high pressure fluid through a 20 GPM flow control orifice 357, line 358, line 360 and through a pilot valve 362 (in the position shown) to line 364 connected to the centralizer 40 to close it about the drill string. At the same time high pressure fluid flows to line 366, line 368, through a pilot valve 370 (in the position shown), through pilot-to-open check valve 374, line 376 to lines 378 and 380 and into the roller clamp cylinders 260 and 262, respectively, to clamp the coupling. The centralizer 40 is closed and the coupling is clamped essentially at about the same time. At the same time, a pilot-to-close check valve 382 is closed by flow of pressurized fluid through line 366 to prevent the driven rollers 322 from being rotated by hydraulic motors 324 at any time during the sequence of operations required for adding a drill string section. During this sequence, a pilot-to-open check valve 386 remains closed and pilot valve 362 remains unactuated in the open position as shown.

When the hydraulic pressure in the centralizer 40 and roller clamp cylinders 260 and 262 rises above 1750 p.s.i., the sequence valve 388 opens thereby establishing fluid flow through line 390, line 392, through check valve 394, line 336, through the pilot valve 338 (in the position shown) to line 340 to activate the drill feed cylinder 42 so that the threaded shank portion 22 applies an upward force on the coupling which is clamped in the roller clamp assembly. This upward force is not sufficient to overcome the clamping force of the roller clamp assembly. As sequence valve 388 is opened, fluid also flows through lines 396 and 398 to open the pilot-to-open check valves 400 and 402 to permit fluid flow from line 336 to sequence valves 404 and 406.

When the fluid pressure in the drill feed cylinder 42 rises to 500 p.s.i. from the upward force on the coupling, sequence valve 404 is opened which allows fluid flow through a cam operated valve 408 (in the position shown), check valve 410, line 348, through the pilot valve 350 (in the position shown), to line 352 to actuate the drill motor 20 to rotate the threaded shank portion 22 and unscrew the shank portion from the coupling clamped in the roller clamp assembly.

As the shank portion becomes free of the clamped coupling, the drill motor 20 continues to move upward until it actuates the cam operated valve 408 mounted near the top of mast 14 as shown in FIG. 2. This actuation shuts off fluid flow to the drill motor 20 and stops rotation of the shank portion 22. The upward travel of the drill motor is stopped when it contacts the stop 55, illustrated in FIG. 2, at the top of mast 14. This positions the drill motor so that the shank portion 22 is above the upper end of the top coupling of the drill string section to be added. Typically, the separation is approximately 4".

In response to the drill motor 20 abutting the stop 55, the fluid pressure again rises in the drill feed cylinder 42 until it reaches 750 p.s.i. At this pressure, sequence valve 406 is opened to allow fluid to flow through a check valve 414 into roller clamp cylinders 260 and 262, which are already activated, to close the roller clamp assembly. Fluid flow is also established to the pilot-to-open check valve 386 through line 416 to open this valve. As check valve 386 opens, fluid flows from line 360 through check valve 418 to line 420, through an unactuated cam operated valve 422 (in the position shown), line 424, through check valve 425, a flow control orifice 426 to line 428. This activates the storage rack swing cylinder 100 and permits flow through line 430 into hydraulic cylinder 246 to extend the retractable pin 244. A 17 GPM flow control orifice 429 and check valve 431 are provided to insure positive extension of pin 244 independent of the force necessary to pivot the storage rack by means of the swing cylinder 100. Activation of storage rack swing cylinder 100 pivots the cylindrical storage rack 34 from the retracted position to the indexing position and automatically indexes a drill string section on the drill string axis X—X as explained. During this pivotal motion, the pilot valve 362 remains unactuated.

After the cylindrical storage rack 34 is pivoted to the indexing position so that the retractable pin 244 abuts against the inner surface of slot 250, the fluid pressure increases in the line 424. When the pressure in this line rises to 2500 p.s.i., a sequence valve 432 opens thereby establishing a flow to actuate pilot valves 338, 350 and 370 to reverse flow to the drill feed cylinder 42, drill motor 20 and roller clamp cylinders 260 and 262. Actuating the pilot valve 370 allows high pressure fluid to flow through line 433, through lines 435 and 437, and into the opposite side of the pistons in the roller clamp cylinders 260 and 262. The pressure on both sides of the pistons in the roller clamp cylinders 260 and 262 is now equalized and the clamping force is decreased. However, there still exists a small clamping force due to the unequal area of the cross section exposed to the pressurized fluid, that is, there is a small area on the side of the piston from which the piston rod extends. The drill feed cylinder 42 moves the drill motor 20 downward along the mast 14 releasing the cam operated valve 408 to start the threaded shank portion 22 rotating in the direction opposite arrow 351 to screw into the coupling secured at the top of the added drill string section. This action forces the drill string section downward against the clamping action of the rack members 62 and 64 until the coupling clamped in the roller clamp assembly moves downward into contact with the centralizer. The centralizer assembly is displaced slightly and actuates the cam operated valve 422 mounted on the mast 14, as shown in FIG. 2. Actuation of cam operated valve 422 reverses the direction of flow of high pressure hydraulic fluid to the storage rack swing cylinder 100 and shuts off flow of hydraulic fluid to the drill feed cylinder 42 and drill motor 20 to stop the rotation of threaded shank portion 22. Actuation of valve 422 permits the high pressure fluid to flow from line 420, through line 434 to line 436 and into the hydraulic cylinder 246. This causes the pin 244 to retract. Actuation of the valve 422 also produces flow through line 438 into swing cylinder 100 to pivot the cylindrical storage rack 34 from the indexing position to the retracted position. During the above operation, the flow control 426 insures a positive retraction of pin 244 relatively independent of the force necessary to pivot the storage rack.

As the cylindrical storage rack 34 is pivoted from the indexing position, the rack members 62 and 64 release their grip on the drill steel by overcoming the spring forces on the clamping fingers 118 and 178, leaving a new drill string section in position to continue drilling.

A rig operator then manually actuates the valve 356 into position B to open the centralizer 40 and unclamp the coupling from between the rollers of the roller clamp assembly 36. In position B, valve 356 permits high pressure hydraulic fluid to pass from line 358 through line 442 into the centralizer 40 to cause the centralizer to open. At this point, the drill shank is already threaded into the top coupling and the new piece of steel is threaded into the lower coupling so that the drill string cannot drop into the borehole. Fluid also flows through line 444 to open pilot to open check valve 374 which causes the roller clamp assembly 36 to open by allowing equal pressure, or system back pressure, to flow to both sides of the roller clamp cylinders 260 and 262 through lines 435 and 437. Valve 356 is then permitted to return to its neutral position. Drilling may then be continued by activating the drill feed valve 56 and drill rotation valve 58 in the conventional manner.

The control system 38 of the present invention also controls an automatic sequence of events which removes a drill string section from the top of the drill string 24 and clamps it for storage in the cylindrical storage rack 34 in response to the actuation of a manually operated valve 450. Valve 450 is normally retained in a neutral position blocking flow of hydraulic fluid from line 452 to line 420.

When the borehole 30 has been drilled to the desired depth, the drill feed valve 56 and drill rotation valve 58 are moved to a neutral position to stop the rotation of the drill string 24 and motion of the drill motor 20 downward along the mast. To remove the drill string from the borehole, the drill string is first rattled by conventional means to loosen all couplings. Drill feed valve 56 is then operated into position A so that high pressure hydraulic fluid moves the drill motor 20 upward along mast 14 to lift the drill string 24 upward until the top of the coupling threaded to the lower end of the uppermost drill string section is flush or slightly above the roller clamp assembly 36. Drill feed valve 56 is then allowed to return to the neutral position to shut off flow to the drill feed cylinder 42.

To initiate the sequence of removing the top drill string section the valve 450 is operated to position A, this establishes flow of high pressure fluid through line 452, line 420, line 454 and through check valve 456 to line 364 connected to the centralizer 40 to close the centralizer. High pressure hydraulic fluid also flows through line 420 and line 424 to lines 428 and 430 entering the storage rack swing cylinder 100 and hydraulic cylinder 246, respectively. This causes the pin 244 to extend and pivot the cylindrical storage rack 34 from the retracted position to the indexing position and presenting an empty storage position to receive the top drill string section for removal. The rack members 62 and 64 clamp onto the top drill string section by means of the spring loaded clamping fingers 118 and 178, just above the lower coupling and onto the upper coupling threaded at the top of the drill string section at the shank portion 22. Pilot valve 362 is actuated through line 454 to prevent premature operation of the roller clamp cylinders 260 and 262.

The pivotal motion of the cylindrical storage rack 34 is stopped in the indexing position by retractable pin 244 abutting against the inner surface of slot 250. This causes the hydraulic pressure to rise above 1750 psi in the line 424. At this pressure, sequence valve 388 is opened to establish a fluid flow through the check valve 394, line 336, unactuated pilot valve 338 and through line 340 to activate the drill feed cylinder 42 to raise the drill string until the upper end of the lower coupling of the top section contacts the lower side of the fingers of lower rack member 64. The pilot-to-open check valves 400 and 402 are also opened when sequence valve 388 opens, allowing flow of fluid to sequence valves 404 and 406.

The pressure again rises to 500 psi as the coupling abuts the rack member 64. At this pressure, the sequence valve 404 is opened and permits fluid to flow through unactuated cam operated valve 408, check valve 410, line 348, unactuated pilot valve 350 and through line 352 to activate the drill motor 20 in the direction of arrow 351 to unscrew the threaded shank portion 22 from the top coupling clamped within the upper rack member 62. It will be understood that the rattling of the drill string loosens the threaded connection sufficiently so that the clamping force of the rack member 62 and 64 on the top drill string section is sufficient to hold the drill string against rotation as the threaded shank portion 22 is unscrewed from the top coupling.

When the shank portion is free of the top coupling of the drill string section to be removed, the drill motor 20 moves upwardly along the mast to subsequently operate cam operated valve 408 to shut off flow to the drill motor 20 and stop rotation of the shank portion. The drill motor 20 contacts the stop 55, illustrated in FIG. 2, at the top of mast 14 to prevent further upward motion of the drill motor.

The fluid pressure rises in the line 340 when the drill motor 20 abuts stop 55. When it reaches 750 psi, sequence valve 406 is opened, allowing fluid to flow through check valve 414, line 376 to lines 378 and 380 to actuate the clamp cylinders 260 and 262 to clamp the lower coupling within the roller clamp assembly. The pilot-to-open check valve 386 is also opened, however it has no effect on the sequence of operations at this time.

Pilot-to-close valve 382 remains open since there is no pilot pressure to close it during the drill string section removal operation. The sequence valve 458 causes the fluid pressure in the roller clamp cylinders 260 and 262 to rise to 2,000 psi. At 2,000 psi the valve 458 is actuated to allow fluid to flow to the hydraulic motors 324. The driven rollers 322 are rotated in the direction of arrow 459 to rotate the lower coupling in a direction which unscrews this coupling while moving it in a downward direction away from the drill string section to be removed. The rate of downward motion is synchronized with the thread pitch of the drill string section in the manner as described hereinabove.

When the lower coupling contacts the centralizer 40, it displaces the centralizer assembly slightly, actuating cam operated valve 422. The actuation of valve 422 establishes a high pressure hydraulic fluid flow from line 420 through line 434 to lines 436 and 438 to retract cylinder 246. This fluid flow also activates the storage rack swing cylinder 100 to pivot the cylindrical storage rack 34 from the indexing position to the retracted position thereby permitting the removal of the drill string section and storing it in the retracted position. The valve 450 is then permitted to return to its neutral position shutting off all pressure to the control system 38, leaving the centralizer 40 and roller clamp assembly 36 closed.

The next section of drill string to be removed is set up for the automatic sequencing of the removal operation. Drill feed valve 56 and drill rotation valve 58 are operated in the conventional manner to move the drill motor 20 downward along the mast until the cam operated valve 408 is released to permit the threaded shank portion 22 to rotate in the direction to screw into the top coupling of the drill string. When the drill motor 20 has been lowered to the point where the threaded shank portion 22 begins to screw into the top coupling, which is now the top coupling of the next section of drill string to be removed, valve 356 is activated to position B. This establishes a fluid flow to open the centralizer 40 and cause the roller clamp assembly 36 to open by allowing equal pressure to flow to both sides of the roller clamp cylinders 260 and 262. Valve 356 is then released to its neutral position and the drill rotation valve 58 is released to its neutral position to prevent further rotation of the threaded shank portion 22. The drill string 24 is then raised to a point where the coupling at the lower end of the top drill string section is flush or slightly above the roller clamp assembly 36 as described above to remove the next section. The operation of the cylindrical storage rack 34, as described above, positions the next storage position to receive the next drill section to be removed.

Activation of valve 450 into position B will introduce pressurized hydraulic fluid into the storage rack swing cylinder 100 to pivot the cylindrical storage rack 34 to the retracted position. It also permits high pressure hydraulic fluid to enter the hydraulic cylinder 246 to retract the pin 244. The operator therefore has the capability to move the cylindrical storage rack into the retracted position if so desired.

In operation, the automatic sequence of either adding or removing a drill string section from the drill string was completed in a working embodiment in a time period of five to eight seconds.

It can be readily understood from the description above that the present invention provides a mechanism which stores a number of drill string sections in storage positions and sequentially indexes each storage position on a drill string axis. The mechanism also automatically adds or removes a drill string section to a drill string. The mechanism may be used with drill string sections having any cross sectional configuration and, in particular, a hexagonal cross section and the drill string sections may be alternated to equalize the wear on the sections by manually rotating the cylindrical storage rack 34.

While a single embodiment of the present invention has been described in detail herein and shown in the accompanying Drawings, it will be evident that various further modifications are possible without departing from the scope of the invention.

I claim:

1. A storage rack for storing drill string sections for use with a drill unit having a mast, comprising:

upper and lower support arms secured at spaced apart positions along the mast;

a pivot shaft mounted between said upper and lower support arms to allow for pivotal motion;

upper and lower swing arm members secured at first ends to said pivot shaft adjacent said upper and lower support arms, respectively;

a center shaft rotatably mounted between said upper and lower swing arm members at the ends opposite said first ends;

an upper rack member mounted for rotation to said center shaft adjacent said upper swing arm member and having four arms extending outwardly, each arm comprising a fixed finger having a generally planar inner surface for contacting a first side of a coupling on a drill string section, a clamping finger having a generally arcuate inner surface with a notch formed therein for contacting the opposite side of the coupling at least at two points, means pivotally mounting said clamping finger to said arm, spring means for biasing the inner surface of said clamping finger toward the inner surface of said fixed finger to form a clamp for clamping the coupling therebetween, and a fixed stop for limiting the motion of said inner surface of said clamping finger toward said inner surface of said fixed finger such that motion of said arm toward the coupling after the coupling contacts said fixed and clamping fingers pivots said clamping finger to admit the coupling between the inner surfaces of said fingers to clamp the coupling; and a lower rack member mounted for rotation to said center shaft adjacent to said lower swing arm member and having four arms extending outwardly, each arm being aligned with an arm in said upper rack member and comprising a fixed finger having a generally planar inner surface for contacting a first side of a drill string section, a clamping finger having an inner surface conforming to the cross sectional shape of the drill string section for contacting the drill string section, means pivotally mounting said clamping finger to said arm, spring means for biasing the inner surface of said clamping finger toward the inner surface of said fixed finger to form a clamp for clamping the drill string section therebetween, and a fixed stop for limiting the motion of said inner surface of said clamping finger toward said inner surface of said fixed finger such that motion of said arm toward a drill string section after the section contacts said fixed and clamping fingers pivots said clamping finger to admit the drill string section between the inner surfaces of said fingers to clamp the section.

2. The storage rack of claim 1 wherein said clamping finger of said lower rack member is formed with an inner surface having a generally hexagonal shape to conform to a drill string section having a hexagonal cross section.

3. An apparatus for storing and individually indexing a plurality of drill string sections on a drill string axis for use by a drill unit comprising:

a storage rack having a plurality of drill string section storage positions about the outer periphery thereof and having camming surfaces adjacent each drill string section storage position, said storage rack being mounted for rotation about a center axis and for pivotal motion relative to the drill unit so that drill string sections stored in the storage positions are aligned parallel with the drill string axis;

means for pivoting said storage rack between a retracted position and an indexing position to index one storage position so that a drill string section stored therein is indexed on the drill string axis;

means for rotating said storage rack to sequentially position each of the other storage positions so that a drill string section stored therein is indexed on the drill string axis as said pivot means again pivots said storage rack into the indexing position, which includes:

a first means mounted to the drill unit for contacting a camming surface adjacent one drill string section storage position to rotate the storage rack as said rack is pivoted to the indexing position to index a storage position so that a drill string section stored therein is positioned on the drill string axis; and second means mounted to the drill unit for contacting a camming surface adjacent a drill string section storage position for further rotating said storage rack as said storage rack pivots to the retracted position so that another storage position is positioned to index a drill string section stored therein on the drill string axis on further pivotal motion of said storage rack to the indexing position.

4. The apparatus of claim 3 further comprising means for limiting the pivotal motion of said storage rack between the retracted and indexing positions.

5. The apparatus of claim 3 further comprising means for locking said storage rack to prevent rotation thereof when said storage rack is in the indexing position.

6. The apparatus of claim 3 further comprising means for supporting individual drill string sections stored in the storage positions of said storage rack in the retracted position.

7. The apparatus of claim 5 wherein said locking means comprises a spring detent and notched surface for receiving said detent, said detent and surface secured between said storage rack and said drill unit for resisting rotation of said storage rack as a storage position is indexed to the drill string axis.

8. A drill string section indexing mechanism for indexing a drill string section having a coupling secured at the upper end thereof on a drill string axis in a drill unit comprising:

an upper rack member having a plurality of clamps about the outer periphery thereof, each for clamping the coupling of a drill string section;

a lower rack member spaced from said upper rack member and having a plurality of clamps about the outer periphery thereof aligned with said clamps in said upper rack member to define a plurality of storage positions, each clamp for clamping the lower end of a drill string section and having a camming surface thereon;

a center shaft interconnecting said upper and lower rack members for common rotation;

means for pivotally mounting said center shaft to the drill unit for pivoting said rack members from a retracted position to an indexing position, said center shaft being rotatably mounted in said means for mounting;

a support plate fixed to said means for mounting spaced below said lower rack member;

a retractable pin mounted to the drill unit for contacting the camming surface of a clamp of said lower rack member for rotating said rack members so that one storage position moves from a first location when said rack members are in the retracted position to a second location centered on the drill string axis as said rack members are pivoted to the indexing position, said support plate supporting drill string sections secured in the storage positions until a storage position is in the second location, said retractable pin being retracted as said rack members pivot from the indexing position to the retracted position;

a fixed pin mounted to the drill unit for contacting the camming surface of a clamp of said lower rack member for further rotating the rack members so that a storage position adjacent the one storage position is rotated to the first location as said rack members are pivoted from the indexing position to the retracted position; and said drill string section indexing mechanism sequentially positioning each of the storage positions at the second location as said rack members are pivoted between the retracted and indexing positions.

9. The mechanism of claim 8 further comprising means to stop the pivotal motion of said rack members in the retracted and indexing positions.

10. The mechanism of claim 8 wherein said support plate is formed having arcuate slots therein for receiving said retractable and fixed pins, the end surface of the slots acting to stop the rack members in the retracted and indexing positions.

11. The mechanism of claim 8 further comprising means for locking said rack members to resist rotation thereof when positioned relative to said support plate so that a storage position is positioned at either the first or second locations in the retracted and indexing positions, respectively.

12. The mechanism of claim 11 wherein said locking means comprises:

a plurality of spring detents, each spring detent being mounted on a clamp of said lower rack member; and a block mounted on said support plate having first and second notches formed therein for receiving said spring detents to lock said rack members.

13. The mechanism of claim 8 wherein said retractable pin rotates said rack members 70° about the axis of rotation of said center shaft and said fixed pin rotates said rack members 20° in the same direction of rotation about the axis of rotation of said center shaft.

14. An apparatus for use with a drill unit for clamping a section of a drill string along a drill string axis, comprising:

guide means secured to the drill unit;

first jaw means mounted for motion along said guide means and defining a surface for contacting the section;

second jaw means mounted from motion along said guide means and defining a surface for contacting the section;

means for moving said first and second jaw means along said guide means to clamp the section therebetween;

said first and second jaw means being centered with respect to the section when in the clamping position;

each section of the drill string being threadedly connected to an adjacent section; and at least one said jaw means includes a roller mounted for rotation about an axis therein, said roller defining the contacting surface, said jaw means further having means for rotating said roller to rotate one section relative to the adjacent section.

15. The apparatus of claim 14 wherein the threads interconnecting the one section and adjacent section have a predetermined pitch and said roller is rotatable about an axis canted relative to the drill string axis so that as the section is rotated in a first direction, the section is disconnected from the adjacent section and moved away from the adjacent section at a rate determined by the predetermined pitch of the threads.

16. A roller clamp assembly for use with a drill unit for clamping a section of a drill string along a drill string axis, each section having a generally circular cross section threadedly connected to an adjacent section in the drill string, the threads of the section and adjacent section having a predetermined pitch, comprising:

guide means secured to the drill unit;

a first movable jaw mounted for motion along said guide means and having at least one roller rotatably mounted thereon;

a second movable jaw mounted for motion along said guide means and having at least one roller rotatably mounted thereon;

means for moving said first and second movable jaws along said guide means to clamp the section between said rollers;

means for rotating at least one of said rollers; and the axis of rotation of said rollers being canted relative to the drill string axis so that, as the clamped section is rotated in a first direction, the section is disconnected from the adjacent section and moved away from the adjacent section at a rate corresponding to the predetermined pitch of the threads.

17. The roller clamp assembly of claim 16 wherein said first and second movable jaws are centered with respect to the section along said guide means as the movable jaws are moved to clamp the section between said first and second rollers.

18. The roller clamp assembly of claim 16 wherein the surfaces of said rollers contacting the section have an arcuate indentation to insure a line of contact between said rollers and the section.

19. A roller clamp assembly of a drill unit, said assembly clamping and rotating a coupling having internal threads at a predetermined pitch to be connected to the threaded end of a drill string section as a part of a drill string, comprising:

a first movable jaw comprising upper and lower jaw plates, said jaw plates having aligned arcuate cutouts to surround a portion of the coupling and lips formed along the sides of said jaw plates;

first and second idler rollers mounted for rotation between said upper and lower jaw plates and extending into the cutouts for contacting the outer surface of the coupling, the axis of rotation of said idler rollers being canted from the drill string axis at an angle corresponding to the pitch angle of the threads of the coupling, the surface of said idler rollers contacting the coupling having an arcuate indentation thereon so that the coupling is contacted along a line by said canted idler rollers;

a second movable jaw comprising upper and lower jaw plates, said jaw plates having aligned arcuate cutouts to surround a portion of the coupling;

first and second driven rollers mounted for rotation between said upper and lower jaw plates and extending into the cutouts for contacting the outer surface of the coupling, the axis of rotation of said driven rollers being canted from the drill string axis at an angle corresponding to the pitch angle of the internal threads of the coupling, the surface of said driven rollers contacting the coupling having an arcuate indentation thereon so that the coupling is contacted along a line by said canted driven rollers;

opposed pairs of upper and lower guide plates mounted to the drill unit for guiding said first and second movable jaws and having channels for slidably receiving the lips of said upper and lower jaw plates of said first movable jaw;

means urging said first and second movable jaws together to clamp the coupling between said driven and idler rollers, said first and second movable jaws being centered by the clamping action; and means for rotating said driven rollers in a first direction when the coupling is clamped to rotate the coupling along the drill string axis away from the adjacent drill string section to which it is threadedly secured at a rate corresponding to the pitch of the internal threads of the coupling to disconnect the coupling from the drill string section while maintaining the drill string section and roller clamp assembly fixed relative to the drill string axis.

20. The roller clamp assembly of claim 19 wherein said assembly further comprises stops for limiting the motion of said first and second movable jaws.

21. The roller clamp assembly of claim 19 wherein each of said driven and idler rollers are distributed about the outer periphery of the coupling at approximately 90° relative to the next adjacent roller when the roller is clamped.

22. A method of adding sections to a drill string by a drill unit along a drill string axis, the drill unit including rotating means for the drill string and means for moving the drill string along the drill string axis, the drill string being comprised of sections threadedly interconnected to each other and to the rotating means, comprising the steps of:

clamping the top section of the drill string, said top section being threadedly connected to the rotating means;

disconnecting the rotating means from the top section and moving the rotating means away from the section after clamping the top section;

indexing a next section on the drill string axis above the top section by means of a storage rack having said next section clamped therein in response to the upward movement of the rotating means;

connecting the rotating means to the next section and then rotating said next section and urging said next section toward said top section against the clamping action of said storage rack by means of said rotating means in response to the indexing of the next section on the drill string axis such that said next section is thereby threadedly connected to said top section; and releasing said next drill string from said storage rack after said top section and said next section are connected.

23. The method of claim 22 wherein the step of moving the rotating means away from the top section in response to the clamping thereof includes moving the rotating means a distance at least equivalent to the length of the next section.

24. The method of claim 22 wherein the drill unit further includes a centralizer and the step of clamping the top section further includes the step of activating the centralizer.

25. The method of claim 22 wherein the step of clamping the top section includes the step of actuating a roller clamp to move rollers thereof in contact with the top section.

26. The method of claim 21 wherein the step of indexing the next section on the drill string axis includes the steps of pivoting and rotating the storage rack having stored therein additional sections from a retracted position to an indexing position to index the next section on the drill string axis, said storage rack storing the sections in clamping means, and wherein said step of releasing the next section includes the steps of rotating and pivoting said storage rack from the indexing position to the retracted position, the force of said clamping means being overcome as said storage rack returns to the retracted position to release the next section on the drill string axis.

27. The method of claim 26 wherein the step of pivoting the storage rack from the indexing position to the retracted position is in response to the urging of the next section downward toward the top section.

28. The method of claim 22 wherein the step of connecting the rotating means into the next section further includes the step of reducing the clamping force on the top section in response to the indexing of the next section.

29. A method of adding drill string sections to a drill string having a cutting bit at the lower end operated by a drill unit for drilling a borehole along a drill string axis, the drill unit including means for rotating the drill string and for moving the drill string along the drill string axis, a roller clamp assembly, and a centralizer, each of the drill string sections being interconnected to each other and to the means for rotating by threaded couplings, comprising the steps of:

raising the drill string through the centralizer by moving the means for rotating upward until a first coupling is positioned with said roller clamp assembly;

thereafter, activating the centralizer and said roller clamp assembly to clamp the drill string and the first coupling, respectively, therein;

thereafter, disconnecting the rotating means from said first coupling in response to the activation of said roller clamp assembly and moving the means for rotating upwardly;

pivoting a storage rack for storing a plurality of drill string sections, each of said drill string sections having a coupling threadedly secured at its uppermost end, from a retracted position to an indexing position in response to the upward motion of said means for rotating to position a first drill string section and a second coupling on the drill string axis;

thereafter, connecting said means for rotating to said second coupling in response to the pivotal motion of said storage rack into the indexing position;

thereafter, applying a force to urge said first drill string section, said second coupling, and said means for rotating downwardly such that said first drill string section connects to said first coupling;

thereafter, pivoting said storage rack from the indexing position to the retracted position in response to the downward urging of said first coupling against the centralizer; and opening the centralizer and roller clamp assembly to release the drill string and the first coupling, respectively.

30. The method of claim 29 wherein the step of disconnecting the means for rotating from said first coupling in response to the activating of said roller clamp assembly and moving the means for rotating upward further includes the step of moving the means for rotating upward a distance at least equal to the length of a drill string section and the coupling threadedly secured thereto.

31. The method of claim 29 wherein the step of disconnecting the means for rotating from said first coupling in response to activating said roller clamp assembly and moving the means for rotating upward includes the step of moving the means for rotating upward in contact with a stop secured to the drill unit.

32. The method of claim 29 wherein the step of pivoting said storage rack from a retracted position to an indexing position includes the step of pivoting said storage rack in contact with stop secured to the drill unit in the indexing position, and the step of pivoting said storage rack from the indexing position to the retracted position includes the step of releasing clamps holding the positioned drill string section within the storage rack as the storage rack pivots from the indexing position.

33. The method of claim 29 further comprising the step of reducing the clamping force applied to said first coupling within said roller clamp assembly in response to the positioning of said storage rack in the indexing position.

34. The method of claim 29 wherein the step of applying a force to position the drill string section and second coupling further includes the step of applying a force to position the drill string section and second coupling downward until the lower surface of the first coupling contacts the centralizer, and further including the step of displacing a centralizer to induce the pivoting of the storage rack from the indexing position to the retracted position.

35. A method of removing drill string sections from a drill string having a drill bit at its lower end and operated by a drill unit to drill a borehole along a drill string axis, the drill unit including rotating means for rotating the drill string and for moving the drill string along the drill string axis, each of the sections being threadedly interconnected to each other and to the rotating means, comprising the steps of:

indexing a storage rack on the drill string axis to clamp a first section thereto, said first section being the uppermost member in the drill string and connected to the rotating means;

disconnecting the rotating means from said first section and moving the rotating means upward in response to the indexing of said storage rack;

clamping a second section in a roller clamp assembly, said second section being threadedly secured to the lower end of said first section, in response to the upward motion of the rotating means;

disconnecting said second section from said first section by rotating said second section in said roller clamp assembly in response to the clamping of said second section; and retracting said storage rack to move said first section off the drill string axis.

36. The method of claim 35 further comprising the step of rattling the drill string to loosen the threaded connections prior to unscrewing the rotating means from said first section.

37. The method of claim 35 wherein the drill unit further includes a centralizer, and including the step of activating the centralizer as said storage rack is indexed on the drill string axis.

38. The method of claim 35 further including the step of moving the drill string upward along the drill string axis in response to the indexing of said storage rack until the upper end of said second section contacts said storage rack; and wherein the step of disconnecting the rotating means from said first section being in response to the upward motion of the drill string.

39. The method of claim 38 wherein the step of disconnecting said second section from said first section further comprises the step of rotating said second section until the lower end of said second section displaces the centralizer, and the step of retracting said storage rack is in response to the displacement of the centralizer.

40. A method of removing drill string sections from a drill string having a drill bit at its lower end operated by a drill unit for drilling a borehole along a drill string axis, the drill unit including rotating means for rotating the drill string and for reciprocating the drill string along the drill string axis, and a centralizer, each of the drill string sections being interconnected to each other and to the rotating means by threaded couplings, comprising the steps of:

raising the drill string by moving the rotating means away from the borehole until a first coupling threadedly secured at the lower end of the uppermost drill string section is positioned within a roller coupling assembly;

activating the centralizer and pivoting a storage rack having a plurality of storage positions, each storage position having clamping means and storing an individual drill string section having a coupling threadedly secured at its upper end, from a retracted position to an indexing position to index a storage position on the drill string axis and clamp onto the uppermost drill string section adjacent the first coupling and to a second coupling interconnecting the uppermost drill string section and the rotating means;

disconnecting the rotating means from said second coupling in response to the pivoting of said storage rack and moving the rotating means;

activating a roller clamp assembly in response to the upward motion of the rotating means to clamp said first coupling between rollers rotatably mounted in said roller clamp assembly;

rotating at least one roller in said roller clamp assembly in response to the activation of said roller clamp assembly to disconnect said first coupling from said uppermost drill string section; and pivoting said storage rack from the indexing position to the retracted position in response to the disconnecting of said first coupling from said uppermost drill string section to remove said uppermost drill string section from the drill string.

41. The method of claim 40 further comprising the step of rattling the drill string section to loosen the threaded connections in the drill string prior to disconnecting the rotating means from said second coupling.

42. The method of claim 40 further including the step of raising the drill string upward in response to the pivoting of said storage rack until the upper end of said first coupling contacts said storage rack, said step of disconnecting the rotating means from said second coupling being in response to the contact between said first coupling and said storage rack, and wherein the step of rotating at least one roller in said roller clamp assembly to disconnect said first coupling from said uppermost drill string section further includes the step of rotating said at least one roller until the lower end of said first coupling displaces the centralizer, and said step of pivoting said storage rack from the indexing position to the retracted position being in response to the displacement of said centralizer.

43. An apparatus for individually indexing a plurality of drill string sections on a drill string axis of a drill unit, comprising:

an upper rack member having a plurality of clamping means about the outer periphery thereof;

a lower rack member spaced from said upper rack member and having a plurality of clamping means about the outer periphery thereof;

means for rotatably mounting said rack members such that the clamping means are aligned to define a plurality of storage positions for clamping individual drill string sections therebetween;

means for pivotally attaching said means for mounting to the drill unit for pivotal motion of said rack members from a retracted position to an indexing position;

first means for rotating said rack members as said means for mounting pivots to the indexing position so that one storage position is aligned with the drill string axis in the indexing position to index a drill string section clamped therein on the drill string axis, said first means for rotating including a retractable pin mounted to the drill unit for contacting a camming surface on one of said rack members for rotating said rack members as said first means for mounting pivots to the indexing position; and second means for rotating said rack members as said means for mounting pivots to the retracted position so that the storage position adjacent said one storage position will be aligned with the drill string axis when said means for mounting is again pivoted to the indexing position, said second means for rotating including a fixed pin mounted to the drill unit for contacting a camming surface on one of said rack members for further rotating said rack members as said second means for mounting pivots to the retracted position.

44. The apparatus of claim 43 further comprising means for supporting drill string sections clamped in said storage positions until the storage position is aligned with the drill string axis.

45. The apparatus of claim 43 further comprises:

means for stopping the pivotal motion of said means for mounting in the retracted and indexing positions; and means for locking said rack members to resist rotation of said members in the retracted and indexing positions.

46. The apparatus of claim 43 further comprising a support plate fixed to said means for mounting beneath said lower rack member to support drill string sections stored in storage positions until a drill string section is indexed on the drill string axis, said support plate further having first and second slots formed therein for receiving said retractable and fixed pins, respectively, each of said slots having an end surface to abut against said pins for stopping the pivotal motion of said means for mounting in the retracted and indexing positions.

47. The apparatus of claim 46 further comprising notches formed in said support plate for cooperating with spring detents secured to said lower rack member for locking the rack members to resist rotation thereof in the retracted and indexing positions.

* * * * *